US007309028B2

(12) United States Patent
Langhans et al.

(10) Patent No.: US 7,309,028 B2
(45) Date of Patent: Dec. 18, 2007

(54) PORTABLE SPRAYER

(75) Inventors: Klaus Langhans, Winnenden (DE); Michael Raffenberg, Fellbach (DE); Bettina Zitzmann, Esslingen (DE)

(73) Assignee: Andreas Stihl AG & Co. KG (DE)

( * ) Notice: Subject to any disclaimer, the term of this patent is extended or adjusted under 35 U.S.C. 154(b) by 218 days.

(21) Appl. No.: 11/248,816

(22) Filed: Oct. 12, 2005

(65) Prior Publication Data

US 2006/0091235 A1 May 4, 2006

(30) Foreign Application Priority Data

Oct. 29, 2004 (DE) ..... 10 2004 052 649

(51) Int. Cl.
*B05B 9/08* (2006.01)

(52) U.S. Cl. ..... 239/152; 239/600; 239/142; 239/153; 239/369; 239/434; 222/175; 415/119

(58) Field of Classification Search ..... 239/129, 239/142, 144, 152, 153, 154, 340, 369, 426, 239/433, 434, 600; 222/175, 333; 415/119, 415/202; 15/327.5; 267/136, 137
See application file for complete search history.

(56) References Cited

U.S. PATENT DOCUMENTS

| | | | | |
|---|---|---|---|---|
| 3,040,471 | A * | 6/1962 | Blase | 239/152 |
| 3,421,697 | A | 1/1969 | Marks | |
| 4,461,055 | A * | 7/1984 | Zerrer et al. | 15/327.5 |
| 4,600,129 | A * | 7/1986 | Kondo | 222/175 |
| 4,658,778 | A * | 4/1987 | Gamoh et al. | 239/153 |
| 5,052,073 | A * | 10/1991 | Iida | 15/327.5 |
| 5,395,052 | A * | 3/1995 | Schneider et al. | 239/154 |
| 6,370,729 | B2 * | 4/2002 | Miyamoto | 15/327.5 |
| 6,575,695 | B1 | 6/2003 | Miyamoto | |
| 6,688,538 | B2 * | 2/2004 | Nemoto et al. | 239/152 |
| 6,729,558 | B1 * | 5/2004 | Seenauth | 239/152 |
| 6,857,163 | B2 * | 2/2005 | Iida et al. | 15/327.5 |

FOREIGN PATENT DOCUMENTS

| | | |
|---|---|---|
| DE | 17 82 915 | 3/1976 |
| JP | 02245257 | 10/1990 |

* cited by examiner

*Primary Examiner*—Steven J. Ganey
(74) *Attorney, Agent, or Firm*—Robert W. Becker; Robert W. Becker & Associates

(57) ABSTRACT

A portable sprayer having a backpack to which are secured a blower unit and a supply tank. The blower unit includes a drive motor and a blower driven thereby. The blower unit is mounted on the backpack by at least one anti-vibration element. The supply tank, for example for spray agent, is mechanically separated from the blower unit and is also mounted on the backpack by at least one anti-vibration element. A removable, at least approximately rigid connection element is provided for coupling the supply tank and the blower unit together or for isolating them from one another with respect to vibrations.

10 Claims, 2 Drawing Sheets

PORTABLE SPRAYER

The instant application should be granted the priority date of Oct. 29, 2004, the filing date of the corresponding German patent application 10 2004 052 649.4-51.

BACKGROUND OF THE INVENTION

The present invention relates to a portable sprayer having a backpack on which are secured a blower unit and a supply unit for a spray agent.

Portable sprayers of the aforementioned type are used in the fruit, wine and vegetable industries for the application of plant protection agents. In the supply tank, a plant protection agent that is placed therein is made available for the spraying process. By means of the blower unit, an air stream is produced that discharges the spray agent out of the supply tank, atomizes it and supplies it to the plants that are to be treated. For different applications, plant protection agent in the form, for example, of a liquid, a powder, or a granulate, is provided.

To keep the effect of vibration on the operator low, the motor-blower unit of such sprayers are isolated from the backpack with respect to vibrations via an anti-vibration system. With known configurations, the blower unit is mechanically separated from the supply tank. At least one anti-vibration element is provided, by means of which the blower unit is suspended from the backpack. The anti-vibration element or elements are such that over the operating range of the excitation frequencies that are to be anticipated, as good a vibration isolation as possible results. The mechanically separated supply tank is independently secured to the backpack.

It has become evident that the aforementioned vibration isolation, which is optimized for operation with liquid spray agent, is suitable only to a limited extent for the application of pulverous or granular material. For the application of such material from the supply tank, a certain level of vibration is advantageous. Appropriately optimized configurations provide a mechanical coupling of the supply tank with the blower unit for the application of solid plant protection agent. Vibrations of the drive motor, which is embodied as an internal combustion engine, and which vibrations are caused by operation, are transferred to the supply tank and to the material stored therein. The level of vibration at the tank prevents the formation of clumps or other mechanisms for the accumulation of material in the supply tank, thereby facilitating a fine-grained charge out of the tank and into the motor-driven blower.

A rigid connection of the supply tank with the blower unit leads to the increase of the oscillating or vibrating mass. Therefore, for an effective vibration isolation, the anti-vibration elements between the blower unit and the backpack must be made correspondingly more rigid.

If it is not desired to provide two different sprayers for the application of liquid material on the one hand or pulverous granular material on the other hand, it is necessary, for the respective application, to provide an expensive conversion along with the labor associated therewith. The soft anti-vibration (AV) suspension provided during operation with liquid material is too soft for the coupling-on of the supply tank for the application of pulverous or granular material due to the additional mass of the supply tank. A more rigid AV setting for the vibrationally mechanical unit composed of blower unit and supply tank for the application of pulverous or granular material is, in contrast, too stiff for the conversion to a supply tank, for liquid material, that is mechanically separated from the blower unit, and leads to undesirably high vibrational stressing of the operator during the application of liquid material.

It is therefore an object of the present invention to improve a portable sprayer in such a way that, while providing a universal usability for the application of liquid and pulverous or granular material, it is possible, with little conversion expense, to respectively achieve a high carrying and operating comfort for the user.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
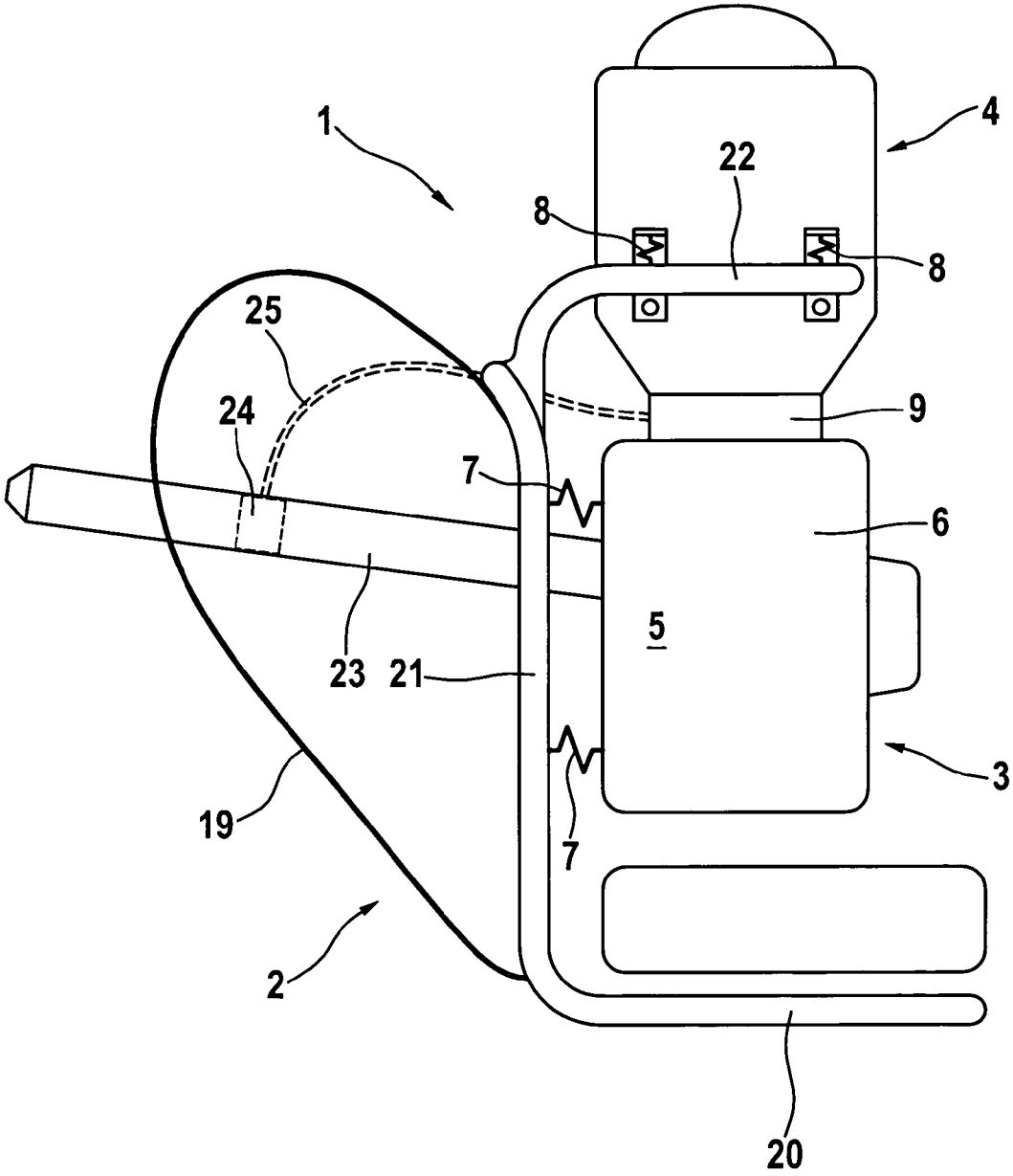
FIG. 1 is a side view showing one exemplary embodiment of a portable sprayer having a backpack on which a blower unit and a supply tank are respectively secured by means of AV elements and are interconnected via a connection element.

A portable sprayer is proposed according to which the blower unit is suspended on the backpack via at least one anti-vibration element, whereby the supply tank, which is mechanically separated from the blower unit, is also suspended or mounted on the backpack via at least one further anti-vibration element. In addition, a removable, at least approximately rigid connection element is provided for coupling the supply tank and the blower unit together, or for isolating them from one another, with respect to vibrations.

The at least one anti-vibration element, or plurality of anti-vibration elements, between the blower unit and the backpack are advantageously designed for an operation of the blower unit with the supply tank uncoupled therefrom, in other words, with the connection element removed; on the other hand, the at least one anti-vibration element or plurality of anti-vibration elements between the supply tank and the backpack are designed such that the combination of the anti-vibration element or elements between the blower unit and the backpack and the anti-vibration element or elements between the supply tank and the backpack are coordinated to the operation of the sprayer with the connection element inserted, in other words, with the supply tank coupled on. In this connection, for the application of liquid material the connection element is removed, so that there is no direct mechanical coupling between the blower unit and the supply tank. The adapted AV element or elements of the blower unit can be relatively soft, since they have to support only the mass of the blower unit. With regard to their rigidity and dampening properties, these AV elements are set to the vibration characteristic and the excitation frequency range of the internal combustion engine and blower that are anticipated during operation in such a way that a vibration isolation relative to the backpack, and hence to the user, that is as effective as possible is achieved. The AV elements of the separately mounted supply tank are, in this operating mode, of secondary or minor significance for the vibrational stressing of the user.

Upon conversion to operation for the application of pulverous or granular material, it is merely necessary to insert the connection element, as a result of which a vibration-transferring connection between the blower unit and the supply tank is established such that both sub-assemblies form a unit with respect to vibration. The vibrations of the drive motor are transferred to the supply tank and to the material disposed therein. The application of, for example, dust, powder or granulate, is enhanced. At the same time, the rigid connection of the two sub-assemblies from a vibrationally mechanical standpoint effects a parallel connection of the AV elements of the blower unit and of the AV elements of the supply tank, which are now effective in combination. The overall suspension or mounting becomes stiffer. The design of the AV elements between the supply tank and the backpack is expediently such that a coordination of the combination of the AV element groups is achieved such that their overall rigidity and overall dampening approximately compensates for the mass resulting from the coupling of the supply tank to the blower unit. The AV elements of the supply tank are designed such that in combination with the AV elements of the blower unit, the resulting rigidity and overall dampening is coordinated to the excitation frequency range and the overall mass of blower unit and supply tank. Consequently, also in this operating mode an effective vibration isolation from the backpack and hence from the operator can be achieved. For the conversion, it is merely necessary to disassemble or remove the connection element. In both operating modes, the level of vibration at the backpack or at the operator is low. Carrying and operating comfort are correspondingly improved.

The connection element is advantageously provided for the positively engaging insertion between the supply tank and the blower unit. With structurally straightforward means, the positive engagement effects a rigid connection between the two sub-assemblies accompanied by an effective transfer of vibration. A desired level of vibration is established in the supply tank. At the same time, the precisely defined vibrationally mechanical connection permits an exact setting of the AV elements. An effective isolation relative to the backpack, and hence to the operator, is simplified. The positively engaging insertion, or the removal, of the connection element can be carried out with few manipulations.

For this purpose, an embodiment is in particular provided where a plane of separation is formed between the supply tank and the blower unit, whereby on the supply tank and on the blower unit respective positively engaging receiving means are provided for the insertion of the connection element, which is effected in the plane of separation. For the advantageous lateral insertion in the plane of separation, no change in position of the supply tank relative to the blower unit is necessary. The coupling and uncoupling, with respect to vibration, can be effected without further alteration features merely by the insertion or withdrawal of the connection element. The conversion expense is correspondingly low.

Pursuant to an advantageous further development, the connection element forms a removable base of the supply tank. In this connection, a discharge device for a pulverous or granular material is expediently disposed on the removable base. The insertion of the connection element not only establishes the coupling with respect to vibration, but also at the same time brings about an adaptation of the base area of the supply tank. The material that has dropped to the base region can be drawn off directly by the blower, without additional adaptations, and can then be supplied to the plants that are to be treated.

By means of the inserted connection element, a flow-guiding connection between an interior of the supply tank and an intake connector of the blower is expediently established. During operation, the intake connector of the blower, without any additional measures, can draw the pulverous or granular spray agent out of the interior of the tank. From there, it is effectively discharged through the blower and through a blower tube that is disposed downstream from the blower. In addition to the uncoupling with respect to vibration, the insertion of the connection element at the same time also establishes the fluidic flow path of the pulverous or granular material.

Pursuant to an advantageous further development, an independent base portion of the supply tank, and possibly also an independent cover portion for the intake connector of the blower, can respectively be provided as a replacement for the removed connection element. During conversion from operation with solid material to an operation with liquid spray agent, it is merely necessary to withdraw the connection element. At its location, the independent base portion and/or the independent cover portion is inserted into the respective positively engaging receiving means. The supply tank and the blower are sealed off. By means of a withdrawal opening, preferably provided in the independent base portion, the liquid plant protection agent can be withdrawn. For this purpose, a venturi device is provided, especially in a blower tube that is disposed downstream of the blower; the venturi device draws off the liquid plant protection agent out of the supply tank via a tubing or hose connection. An effective application of the protective plant agent is ensured without having liquid contact the blower. At the same time, due to the independent cover portion an effective sealing of the intake connector is ensured. The entire blowing capacity of the blower can be deployed.

Further specific features of the present application will be described in detail subsequently.

DESCRIPTION OF SPECIFIC EMBODIMENTS

Referring now to the drawings in detail, the schematic side view of FIG. 1 shows a portable sprayer 1 that has a backpack 2. This backpack includes a frame 20 that can expediently be comprised entirely or partially of aluminum tubing. The frame 20 has an approximately vertical central portion 21 and an approximately horizontal upper portion 22 that is bent off at right angles to the central portion 21. Provided on the central portion 21 are shoulder straps 19 by means of which the sprayer 1 can be carried on the back of an operator.

The sprayer 1 furthermore includes a blower unit 3 as well as a supply tank 4. The blower unit 3 comprises a drive motor 5 that is not illustrated in detail and that is embodied as an internal combustion engine; the blower unit 3 also comprises an indicated blower 6, which in the illustrated embodiment is embodied as a radial blower and is driven by the drive motor 5. The blower 6 conveys an air stream through a blower tube 23. This blower tube is movable relative to the blower 6, and can be guided by the operator into the desired spraying direction.

The blower unit 3 is suspended on the central portion 21 of the backpack 2 by at least one anti-vibration element 7 in a vibration-isolating manner. In the illustrated embodiment, a plurality of anti-vibration (AV) elements 7 are provided, with only two AV elements 7 being shown in order to facilitate illustration.

The supply tank 4 is suspended on the upper portion 22 of the backpack 2, independently of the blower unit 3, and hence mechanically separated therefrom, via further-anti-vibration elements 8. Overall, at least one AV element 8 is necessary. In the illustrated embodiment, a plurality of AV elements 8 are provided, with only two AV elements 8 being recognizable in FIG. 1.

In FIG. 1, the blower unit 3 and the supply tank 4 are connected by means of an at least approximately rigid connection element 9, and hence are coupled with one another with respect to vibration. The connection element 9 can be removed. In the removed state, the blower unit 3 and the supply tank 4 are isolated from one another from a vibrationally mechanical standpoint, and are independently, separated from one another, secured to the backpack 2 via the associated AV elements 7, 8.

An indicated venturi device 24 is provided in the blower tube 23; within the venturi device, when the air stream that is produced in the blower 6 flows through the blower tube 23, an underpressure or vacuum is generated. If desired, a fluidic connection can be established between the supply tank 4 and the venturi device 24 by means of a tubing 25, which is indicated by dashed lines. The vacuum in the venturi device 24 draws a liquid plant protection agent out of the supply tank 4 through the tubing 25. In the venturi device 24, the liquid plant protection agent is atomized and is supplied by the air stream of the blower tube 23 to the plants that are to be treated. Details regarding the delivery or discharge of a liquid plant protection agent are explained in greater detail in conjunction with FIG. 3.

Alternatively, a solid plant protection agent in the form of a powder, a granulate, or the like can be stored in the supply tank 4, can be drawn out of the supply tank by the blower 6, and can be blown out through the blower 6 and the blower tube 23 together with an air stream produced by the blower 6. Details regarding the operation with solid material will be described in greater detail in conjunction with FIG. 2.

In the configuration of the sprayer 1 shown in FIG. 1, the connection element 9 is inserted between the blower unit 3 and the supply tank 4 in such a way that the blower unit and the supply tank form an at least approximately rigid unit with respect to vibration. This configuration is provided for the operation with solid material. Vibrations of the drive motor 5 and the blower 6 caused by operation are transferred to the supply tank 4 and facilitate discharge of the material, such as pulverous or granular material, contained in the supply tank. The tubing 25, and possibly also the venturi device 24, are, in this connection, dismantled. The sum of all of the AV elements 7, 8 are, with regard to their rigidity and dampening characteristic, coordinated with one another as well as with the overall mass and excitation frequency of the vibration system, comprised of the blower unit 3 and the supply tank 4, in such a way that the total mass of the aforementioned components is, in the operating range of the excitation oscillations, effectively isolated from the backpack 2 and hence from the operator. At the same time, a good transfer of vibration is ensured in a desired manner between the blower unit 3 and the supply tank 4.

Figure 2:
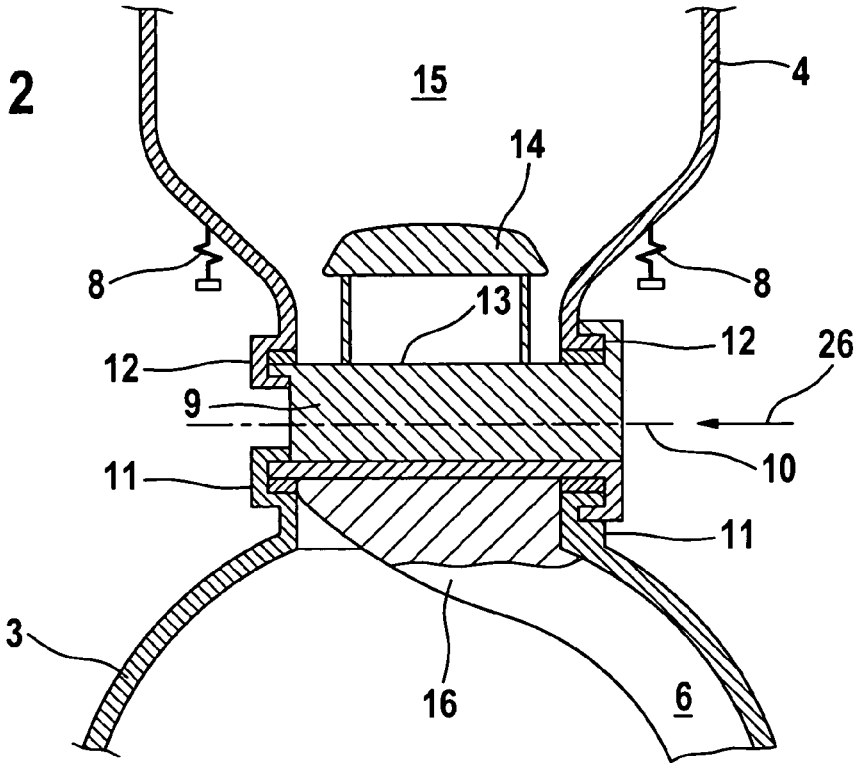
FIG. 2 shows, in a cross-sectional view from the rear, the arrangement of FIG. 1 in a region of the connection location between the blower unit and the supply tank, including a connection element for operation with, for example, pulverous or granular material.

The enlarged cross-section of FIG. 2 shows the region of the connection location between the blower unit 3 and the supply tank 4. A plane of separation 10 is formed between the supply tank 4 and the blower unit 3. Respective positive engagement receiving means 11, 12 are provided on the supply tank 4 and on the blower unit 3; in the illustrated embodiment these receiving means are embodied as grooves and flanges. The cross-sectional geometry of the connection element 9 is such that in the illustrated inserted state, it engages in the receiving means 11, 12 in a positively engaging manner. As can be seen from FIG. 2, the positive or interlocking connection brought about by the receiving means 11, 12 acts essentially transverse to the plane of separation 10. It should be noted that snap connections, quick-release connections or the like could also be provided to effect a positive engagement within the plane of separation 10. The connection element 9 is inserted into the receiving means 11, 12 in the direction of the arrow 26, parallel to the plane of separation 10, in such a way that a vibration mechanical connection is produced between the blower unit 3 and the supply tank 4. If necessary, the connection element 8 can be pulled out in a direction opposite to the arrow 26, whereby the blower unit 3 and the supply tank 4 are then isolated from one another from a vibrationally mechanical standpoint.

In an operational unit, the connection element 9 also forms a removable base 13 of the supply tank 4, and also forms an adapter for an intake connector 16 of the blower 6. Secured to the removable base 13 formed by the connection element 9 is a discharge device 14 for solid material that is to be sprayed. The discharge device 14 is preferably removable together with the connection element 9. In the inserted state, the connection element 9 represents a flow-guiding connection between an interior 15 of the supply tank 4 and the intake connector 16 of the blower 6. The operational vibrations of the blower unit 3 are transferred via the connection element 9 to the supply tank 4 in such a way that solid material stored in the interior 15 of the supply tank 4 trickles to the discharge device 14. From there, the material is drawn through the connection element 9 into the blower 6 via the intake connector 16. The air stream of the blower 6 conveys the solid material that is to be sprayed through the blower tube 23 (FIG. 1) to the desired location.

Figure 3:
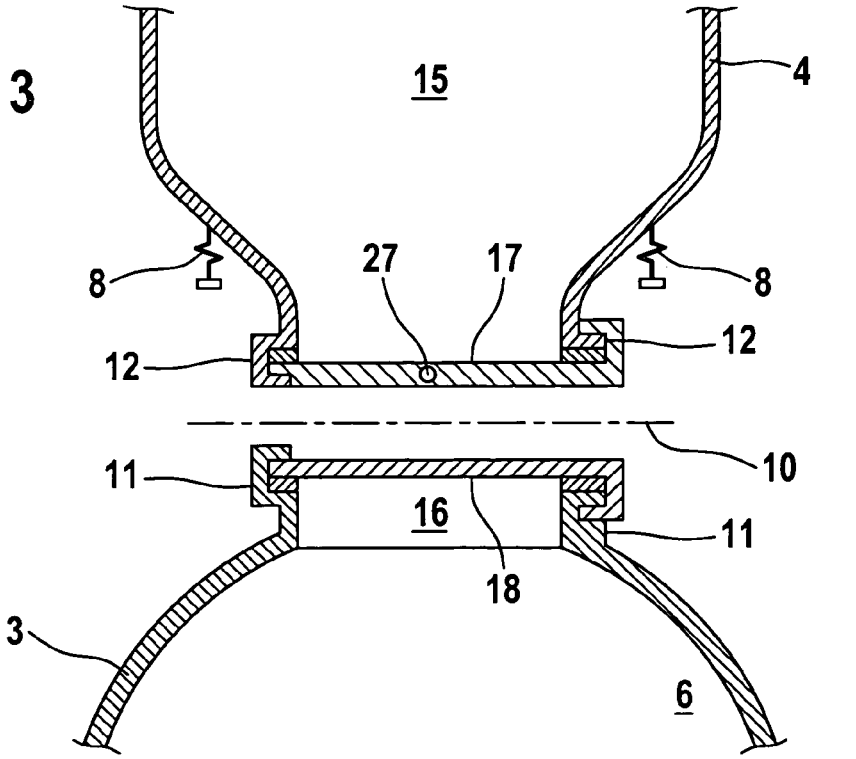
FIG. 3 the arrangement of FIG. 2 with the connection element removed, and replaced by a base portion and a cover portion, for operation with a liquid spray agent.

FIG. 3 shows the arrangement of FIG. 2, but with the connection element 9 removed counter to the direction of the arrow 26 (FIG. 2). In place of the connection element 9, an independent base portion 17 is inserted into the positively engaging receiving means 12 of the supply tank 4. A similarly independent cover portion 18 is inserted into the positively engaging receiving means 11 of the blower unit 3 and sealingly covers the intake connector 16 of the blower 6. In this configuration, the base portion 17 and the cover portion 18 are separate components, as a consequence of which the blower unit 3 and the supply tank 4 are separated from one another in the plane of separation 10 from a vibrationally mechanical standpoint.

This configuration is provided for operation of the sprayer 1 (FIG. 1) with a liquid spray agent that is stored in the interior 15 of the supply tank 4. The liquid spray agent is withdrawn through a withdrawal opening 27 in the base portion 17, and is conveyed to the venturi device 24 (FIG. 1) in the blower tube 23 via the tubing 25 that can be optionally provided. The AV elements 7 of the blower unit 3 (FIG. 1) are designed with respect to their rigidity and dampening property in such a way that, taking into consideration the oscillation excitation in the anticipated operational excitation frequency range, and the mass of the blower unit 3 that is isolated from the supply tank 4 from a vibrationally mechanical standpoint, they bring about an effective vibrational isolation of the blower unit 3 from the backpack 2.

With reference to FIGS. 1 to 3, the inventive sprayer 1 can be used not only for the application of liquid spray agent, but also for the application of solid spray agent that is in pulverous, granular or the like form. A conversion between the configuration of FIG. 2, for operation with solid spray agent, and the configuration of FIG. 3, for operation with liquid spray agent, is effected by the selective use of the rigid connection element 9 or the base portion 17 and the cover portion 18. With the rigid connection of the blower unit 3 and the supply tank 4 of FIG. 2, the two sub-assemblies together form a relatively large oscillating mass. This large oscillating mass is opposed by the dampening effect of the overall unit of AV elements 7 and 8, the sum of which is adapted or set in such a way that an effective vibration isolation is formed.

In the separated state of FIG. 3, the oscillation excitation of the drive motor 5 acts only in the sub-assembly of the blower unit 3. The overall mass thereof is lower due to the isolation of the supply tank 4. The mass of the blower unit 3 is supported only by the associated AV elements 7, the overall rigidity and dampening effect of which are correspondingly lower in comparison to the arrangement of FIG. 2 due to the vibrationally mechanical uncoupling of the supply tank 4 and the associated AV elements 8. The rigidity and dampening effect of the AV elements 7, which are effective on their own, are designed and set such that in the operating range of the excitation frequencies that is provided, an effective vibrational isolation is provided relative to the backpack 2, to the supply tank 4, and to the operator.

The specification incorporates by reference the disclosure of German priority document 10 2004 052 649.4-51 filed 29 Oct. 2004.

The present invention is, of course, in no way restricted to the specific disclosure of the specification and drawings, but also encompasses any modifications within the scope of the appended claims.

We claim:

1. A portable sprayer, comprising:

a backpack;

a blower unit mounted on said backpack via at least one first anti-vibration element, wherein said blower unit includes a drive motor and a blower adapted to be driven by said drive motor;

a supply tank for material that is to be applied, wherein said supply tank is mounted on said backpack via at least one second anti-vibration element such that said supply tank is mechanically separate from said blower unit; and a removable, at least approximately rigid connection element for coupling said blower unit and said supply tank together, or isolating said blower unit and said supply tank from one another, with respect to vibrations.

2. A sprayer according to claim 1, wherein said connection element (9) is adapted to be inserted between said supply tank and said blower unit in a positively engaging manner.

3. A sprayer according to claim 2, wherein a plane of separation is formed between said supply tank and said blower unit, and wherein positive engagement receiving means are provided on said blower unit and said supply tank for a lateral insertion of said connection element therein in said plane of separation.

4. A sprayer according to claim 1, wherein said connection element forms a removable base of said supply tank.

5. A sprayer according to claim 4, wherein a discharge device for solid spray agent is disposed on said removable base.

6. A sprayer according to claim 4, wherein said blower is provided with an intake connector, and wherein with said connection element inserted, a flow-guiding connection is established between an interior of said supply tank and said intake connector.

7. A sprayer according to claim 1, wherein said supply tank is provided with an independent base portion as a replacement for said removable connection element.

8. A sprayer according to claim 1, wherein said blower is provided with an intake connector, wherein said blower unit is provided with an independent cover portion for said intake connector as a replacement for said removable connection element.

9. A sprayer according to claim 1, wherein said at least one first anti-vibration element of said blower unit is designed for operation of said blower unit with said connection element removed.

10. A sprayer according to claim 1, wherein said at least one first anti-vibration element of said blower unit, and said at least one second anti-vibration element of said supply tank, are designed for operation of said sprayer with said connection element inserted.

* * * * *